US008988470B2

(12) United States Patent
Kang

(10) Patent No.: US 8,988,470 B2
(45) Date of Patent: Mar. 24, 2015

(54) LUMINANCE CORRECTION SYSTEM FOR ORGANIC LIGHT EMITTING DISPLAY DEVICES

(75) Inventor: Sung-Jin Kang, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 422 days.

(21) Appl. No.: 13/243,797

(22) Filed: Sep. 23, 2011

(65) Prior Publication Data

US 2012/0242710 A1 Sep. 27, 2012

(30) Foreign Application Priority Data

Mar. 24, 2011 (KR) ..... 10-2011-0026309

(51) Int. Cl.
*G09G 5/10* (2006.01)
*G09G 3/32* (2006.01)

(52) U.S. Cl.
CPC ..... *G09G 3/3208* (2013.01); *G09G 2320/0233* (2013.01); *G09G 2320/0242* (2013.01); *G09G 2320/0673* (2013.01); *G09G 2310/0264* (2013.01); *G09G 2360/16* (2013.01)
USPC ..... 345/690

(58) Field of Classification Search
USPC ..... 173/204, 690; 345/204, 690
See application file for complete search history.

(56) References Cited

U.S. PATENT DOCUMENTS 6,567,159 B1 * 5/2003 Corech ..... 356/71
7,728,526 B2 * 6/2010 Lee ..... 315/169.3
2002/0175662 A1 * 11/2002 Sakurai et al. ..... 323/312
2005/0030267 A1 * 2/2005 Tanghe et al. ..... 345/82
2005/0196064 A1 * 9/2005 Sugimoto ..... 382/266
2005/0201615 A1 * 9/2005 Hsu et al. ..... 382/167
2006/0232520 A1 * 10/2006 Park et al. ..... 345/76
2007/0040774 A1 * 2/2007 Lee et al. ..... 345/77
2007/0229435 A1 * 10/2007 Lee ..... 345/98
2008/0007494 A1 * 1/2008 Kim et al. ..... 345/77

(Continued)

FOREIGN PATENT DOCUMENTS

KR 10-2010-0034584 A 4/2010

OTHER PUBLICATIONS

Improve OLED Technology for Display by Jennifer Y. Yu, Ph.D Dissertation, Massachusetts Institute of Technology, Sep. 2008, 151 pages.*

(Continued)

*Primary Examiner* — Quan-Zhen Wang
*Assistant Examiner* — Chun-Nan Lin
(74) *Attorney, Agent, or Firm* — Knobbe Martens Olson & Bear LLP

(57) ABSTRACT

A luminance correction system for organic light emitting display devices is disclosed. In one aspect, an image displayed in a pixel unit of each of the display devices is analyzed and the luminance and color coordinate for main gray-level data is measured. A main-gamma offset value corresponding to the result of image analysis may be generated. A change in voltage of a driving power signal input from an external source of each of the display devices may be sensed. A sub-gamma offset value is generated by applying the change in voltage of the sensed driving power signal. A main-gamma voltage for the main gray level corresponding to the set main-gamma offset value and the set sub-gamma offset value is adjusted and output as an adjusted main-gamma voltage. The adjusted main-gamma voltage may be applied to a data driver of each of the display devices.

16 Claims, 4 Drawing Sheets

(56) References Cited

U.S. PATENT DOCUMENTS

| | | | | |
|---|---|---|---|---|
| 2008/0170014 | A1* | 7/2008 | Jung et al. | 345/82 |
| 2009/0058888 | A1* | 3/2009 | Chou et al. | 345/690 |
| 2009/0267973 | A1* | 10/2009 | Lee | 345/690 |
| 2009/0278773 | A1* | 11/2009 | Chegal | 345/77 |
| 2010/0007680 | A1* | 1/2010 | Yu et al. | 345/690 |
| 2010/0033467 | A1* | 2/2010 | Park | 345/211 |
| 2010/0033514 | A1* | 2/2010 | Park et al. | 345/690 |
| 2010/0039453 | A1* | 2/2010 | Chaji et al. | 345/690 |
| 2010/0073339 | A1* | 3/2010 | Lee et al. | 345/207 |
| 2010/0156927 | A1* | 6/2010 | Takase | 345/589 |
| 2010/0177126 | A1* | 7/2010 | Inoue et al. | |
| 2011/0050737 | A1* | 3/2011 | Yu et al. | 345/690 |
| 2011/0063412 | A1* | 3/2011 | Tsukagoshi | 348/42 |
| 2011/0069096 | A1* | 3/2011 | Li et al. | 345/690 |
| 2011/0141090 | A1* | 6/2011 | Hong et al. | 345/211 |
| 2011/0157217 | A1* | 6/2011 | Brown et al. | 345/605 |
| 2012/0242710 | A1* | 9/2012 | Kang | 345/690 |
| 2013/0169693 | A1* | 7/2013 | Pyo | 345/690 |

OTHER PUBLICATIONS

Pixel Circuits and Driving Schemes for Active-Matrix Organic Light-Emitting Diode Displays by Shahin Jafarabadiashtiani, Ph.D dissertation, 2007, University of Waterloo, Electrical and Computer Engineering, 124 pages.*

Thin Film Transistor Integration for Biomedical Imaging and AMOLED Display by Reza Chaji, Ph.D Dissertation, University of Waterloo, 2008, 177 pages.*

* cited by examiner

FIG. 3A

| Output Voltage (ELVDD) | Luminance ($Cd/m^2$) | Color Coordinate | |
|---|---|---|---|
| | | x | y |
| 4.649 | 319.3 | 0.2868 | 0.3083 |
| 4.649 | 314.6 | 0.2865 | 0.3078 |
| 4.632 | 309.5 | 0.2860 | 0.3071 |
| 4.624 | 304.8 | 0.2856 | 0.3065 |
| 4.615 | 299.9 | 0.2852 | 0.3058 |
| 4.598 | 289.5 | 0.2843 | 0.3044 |
| 4.590 | 284.9 | 0.2838 | 0.3037 |
| 4.581 | 280.1 | 0.2834 | 0.3030 |
| 4.573 | 275.2 | 0.2829 | 0.3023 |
| 4.564 | 271.1 | 0.2825 | 0.3017 |
| 4.556 | 266.0 | 0.2820 | 0.3017 |

FIG. 3B

| Output Voltage (ELVDD) | Luminance ($Cd/m^2$) | Color Coordinate | |
|---|---|---|---|
| | | x | y |
| 4.649 | 289.8 | 0.2828 | 0.3044 |
| 4.649 | 289.2 | 0.2843 | 0.3040 |
| 4.632 | 290.2 | 0.2858 | 0.3048 |
| 4.624 | 289.6 | 0.2829 | 0.3073 |
| 4.615 | 289.4 | 0.2828 | 0.3043 |
| 4.598 | 289.5 | 0.2843 | 0.3044 |
| 4.590 | 289.5 | 0.2859 | 0.3041 |
| 4.581 | 288.9 | 0.2859 | 0.3040 |
| 4.573 | 289.7 | 0.2829 | 0.3044 |
| 4.564 | 289.5 | 0.2844 | 0.3043 |
| 4.556 | 290.1 | 0.2844 | 0.3041 |

LUMINANCE CORRECTION SYSTEM FOR ORGANIC LIGHT EMITTING DISPLAY DEVICES

CROSS-REFERENCE TO RELATED APPLICATIONS

This application claims priority to and the benefit of Korean Patent Application No. 10-2011-0026309, filed on Mar. 24, 2011, in the Korean Intellectual Property Office, the entire content of which is incorporated herein by reference.

BACKGROUND

1. Field

The disclosed technology relates to a luminance correction system, and more particularly, to a luminance correction system applied to organic light emitting display devices.

2. Description of the Related Technology

An organic light emitting display device is a kind of flat panel display device which uses an organic compound as a light emitting material in a light emitting component of the display. Due to the advantages of an organic light emitting display device, including high luminance and color purity, reduced thickness, lightweight and low power consumption characteristics, it is expected that the organic light emitting display device will be used for various types of display devices such as portable display devices, and the like.

The organic light emitting display device generates a data signal having a voltage for each gray level based on a reference gamma voltage, and displays an image corresponding to the generated data signal. As a result, the luminance of each corresponding component of different display devices may be different from a desired luminance due to variations that result from manufacturing.

Where the luminance of a manufactured display device does not meet standards of desired luminance, the display device is considered to be defective and not usable. Therefore, correction of luminance of a flat panel display device based on a measured luminance following completion of the manufacturing process to a desired luminance value may reduce the number of display devices which are deemed defective.

However, if only the luminance were to be corrected, white balance could be distorted due to the efficiency disparity among red, green, and blue pixels. Therefore, in addition to luminance correction it may be necessary to correct color coordinates.

Generally, correction of luminance and color coordinates assumes that the power signal (ELVDD or the like) applied to the organic light emitting display device is always applied at a constant level. Conventionally, DC-DC converters that generate and output power for driving the display were built in, and thus the power signal could maintain a constant level for all displays regardless of the variation in output voltage between the DC-DC converters.

However, DC-DC converters have recently been mounted external to the display. In such configurations, variations occur in power signal levels among displays. As a result, there are variations in luminance.

SUMMARY OF CERTAIN INVENTIVE ASPECTS

According to one aspect, a luminance correction system for organic light emitting display devices is disclosed. The system includes an image analyzing unit configured to analyze an image displayed by a pixel unit of each of the organic light emitting display devices and measure the luminance and color coordinate for main gray-level data, a main-gamma offset generating unit configured to generate a main-gamma offset value for each color data in the main gray level based on a result of image analysis performed by the image analyzing unit, a driving voltage sensing unit configured to sense a change in voltage of a driving power signal input from an exterior source of each of the organic light emitting display devices, a sub-gamma offset generating unit configured to generate a sub-gamma offset value for each color data in the main gray level by applying the change in voltage of the sensed driving power signal, a gamma voltage adjusting unit configured to adjust a main-gamma voltage for the main gray level corresponding to the set main-gamma offset value and the set sub-gamma offset value, wherein the gamma voltage adjusting unit is further configured to output the adjusted main-gamma voltage, and a gamma voltage applying unit configured to apply the main-gamma voltage adjusted by the gamma voltage adjusting unit to a data driver of each of the organic light emitting display devices.

According to another aspect, a method of correcting luminance in organic light emitting display devices is disclosed. The method includes analyzing an image displayed by a pixel unit of each of the organic light emitting display devices, measuring the luminance and color coordinate for main gray-level data, setting a main-gamma offset value for each color data in the main gray level based on a result of image analysis performed by the image analyzing unit, sensing a change in voltage of a driving power signal input from an exterior source of each of the organic light emitting display devices, setting a sub-gamma offset value for each color data in the main gray level by applying the change in voltage of the sensed driving power signal, adjusting a main-gamma voltage for the main gray level corresponding to the set main-gamma offset value and the set sub-gamma offset value, outputting the adjusted main-gamma voltage, and applying the main-gamma voltage adjusted by the gamma voltage adjusting unit to a data driver of each of the organic light emitting display devices.

BRIEF DESCRIPTION OF THE DRAWINGS

The accompanying drawings, together with the specification, illustrate some embodiments of the present invention, and, together with the description, serve to explain some principles of the present invention.

FIGS. 3A and 3B are comparison experimental data showing luminance and color coordinate characteristics corrected by the luminance correction system shown in FIG. 2.

DETAILED DESCRIPTION OF CERTAIN INVENTIVE EMBODIMENTS

Figure 1:
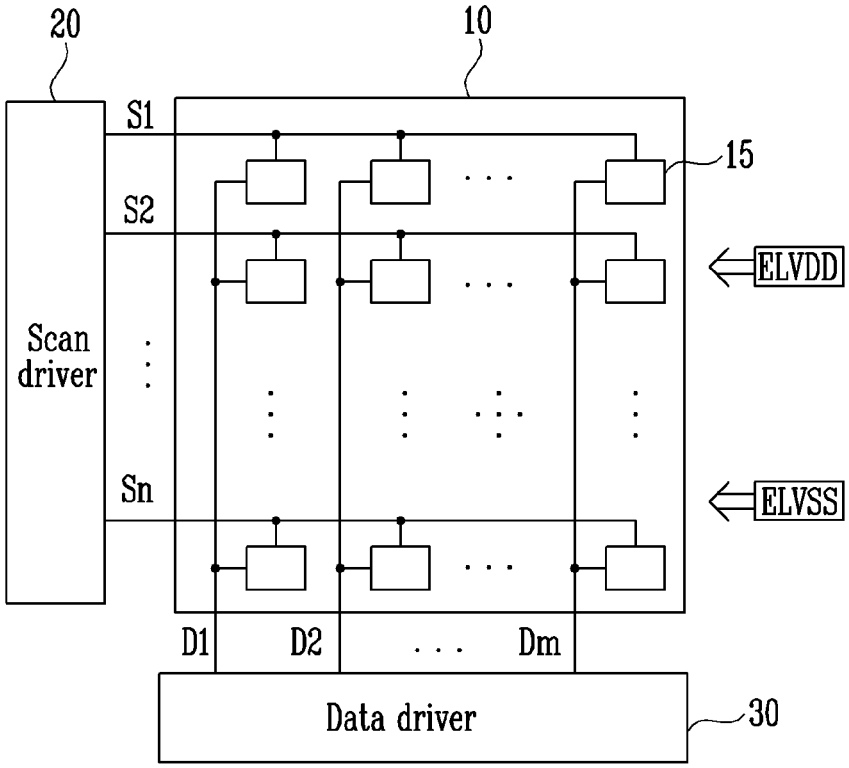
FIG. 1 is a block diagram showing a configuration of an organic light emitting display device according to some embodiments.

Hereinafter, certain embodiments will be described with reference to the accompanying drawings. Throughout the description, when a first element is described as being coupled to a second element, the first element may not only be directly coupled to the second element but may also be indirectly coupled to the second element via a third element. Further, some of the elements that are not essential to the complete understanding of the invention are omitted for clarity. Also, like reference numerals refer to like elements throughout.

Hereinafter, some embodiments will be described in detail with reference to the accompanying drawings.

FIG. 1 is a block diagram showing a configuration of an organic light emitting display device according to some embodiments.

With reference to FIG. 1, the organic light emitting display device according to some embodiments includes a pixel unit 10, a scan driver 20 and a data driver 30.

The pixel unit 10 includes a plurality of pixels 15 arranged in a matrix at intersecting portions of scan lines S1 to Sn and data lines D1 to Dm. The pixel unit 10 is driven by receiving driving power signals such as a high-level first power signal ELVDD and a low-level second power signal ELVSS, supplied from an external source to the organic light emitting display device. According to some embodiments, the power signal may also be provided within the same device housing the organic light emitting display device.

Each of the pixels 15 that are provided within the pixel unit 10 stores a voltage corresponding to a data signal supplied from a data line D coupled to a pixel 15. The stored voltage corresponds to a difference of the voltages between the first power signal voltage and the data signal. When a scan signal is supplied from a scan line S coupled to the pixel 15, and the pixel 15 emits light with luminance corresponding to the stored voltage. Accordingly, an image corresponding to the data signals is displayed by the pixel unit 10.

The scan driver 20 sequentially generates scan signals corresponding to a scan control signal supplied from a timing controller (not shown). The scan signal generated by the scan driver 30 is supplied to the pixels through the scan lines S1 to Sn.

The data driver 30 generates a data signal corresponding to a data control signal and data supplied from the timing controller (not shown). The data signal generated by the data driver 30 is supplied to the pixels 15 through the data lines D1 to Dm such that the pixels are synchronized using the scan signal.

The data driver 30 generates a data signal having a voltage for each gray level based on a predetermined gamma voltage. In a case where dispersion in characteristics of panels occurs due to a variation in a manufacturing process, images with different luminances may be displayed in the respective panels with respect to the same data signal. Therefore, it may also be necessary to correct the measured luminance of each organic light emitting display device for which a manufacturing process has been completed to a luminance level suitable for a desired luminance value.

Therefore, according to some embodiments, a luminance correction system which enables panels of organic light emitting display devices to emit light with the same luminance by correcting a luminance difference generated by the dispersion in characteristics of the panels is disclosed.

According to a conventional luminance correction system, the luminance correction for each panel was performed under the assumption that the driving power signal applied to the pixel unit 10 of each panel is always applied at a constant level.

That is, conventionally, DC-DC converters for generating and outputting the power signal were respectively built in the panels of the organic light emitting display devices, and thus the power signal could maintain a constant level for all the panels.

However, in a case where the DC-DC converters are respectively mounted in the panels, manufacturing cost of each of the panels is increased, and the thickness of each of the panels is increased. Recently, it is desirable to provide the DC-DC converter external to the organic light emitting display device panel. For example, a DC-DC converter may be provided as part of a set in which the display device panel is mounted.

In a case where the DC-DC converter is mounted in externally so as to provide power for driving the pixel unit 10 of each of the panels, there may occur a variation in level between power signals provided to the respective display devices, which becomes a main cause of the variation in luminance between the display devices.

Particularly, the first power signals ELVDD among the power signals functions to determine the luminance of an image displayed through the pixel unit 10 of each of the panels. In a case where the conventional luminance correction system is used, a variation in the first power signals ELVDD between the panels is not applied, and therefore, exact luminance correction is impractical and unachievable.

Accordingly, the luminance correction system according to some embodiments is configured to generate a main-gamma offset value for sensing the voltage of the first power signal ELVDD inputted from the exterior of each panel and perform gamma voltage correction for a main gray level based on the sensed voltage. Further, and the luminance correction system sets a sub-gamma offset value for correcting a variation in voltage between the first power signals ELVDD. Finally, the luminance correction system applies the offset values to gamma voltage correction corresponding to the gray level. Thus, it is possible to prevent color coordinates from being distorted in each gray level and luminance value and to minimize a variation in luminance between organic light emitting display devices.

Figure 2:
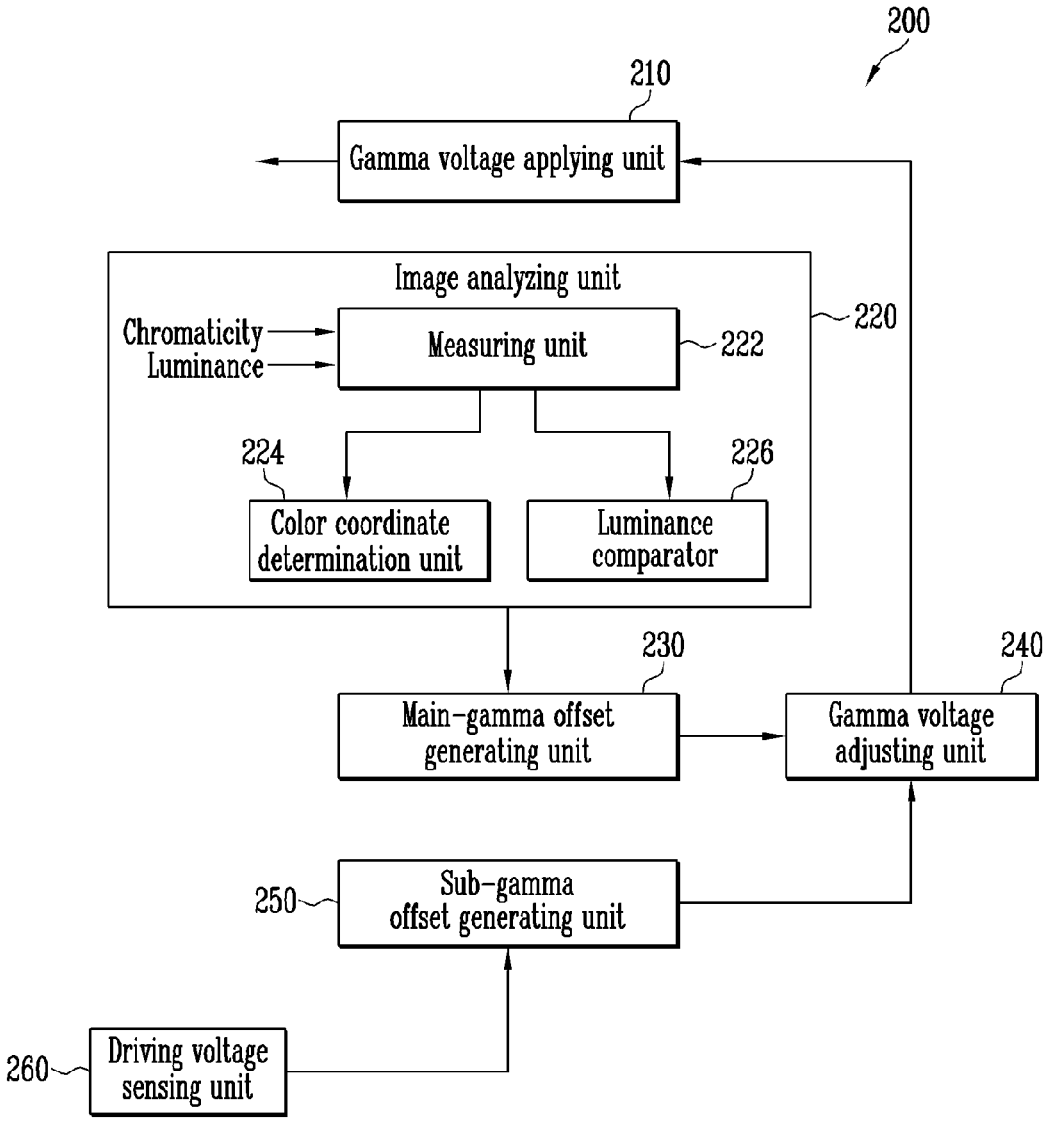
FIG. 2 is a block diagram of a luminance correction system according to some embodiments.

FIG. 2 is a block diagram of a luminance correction system according to some embodiments.

With reference to FIG. 2, the luminance correction system 200 according to this embodiment may be applied to the luminance and color coordinate correction of organic light emitting display devices. The luminance correction system 200 includes an image analyzing unit 220, a main-gamma offset generating unit 230, a gamma voltage adjusting unit 240, a gamma voltage applying unit 210, a sub-gamma offset generating unit 250 and a driving voltage sensing unit 260.

The image analyzing unit 220 measures luminance and color coordinates for main gray-level data by analyzing an image displayed in a pixel unit of each of the organic light emitting display devices.

According to some embodiments, when the data is transmitted to the display device, for example, as 256 gray levels, i.e., 0 to 255 gray levels, the main gray levels may be 255 gray levels and/or 127 gray levels.

That is, in addition to data having the maximum gray level (255 gray level), data having another gray level at an inflection point on the luminance curve panel according to the gray levels (e.g., data having 127 gray levels) may be further applied to a panel of each of the organic light emitting display devices. In this case, the image analysis of the plurality of gray levels can be performed, thereby increasing the accuracy of luminance correction.

The image analyzing unit 220 may include a measuring unit 222 that measures the chromaticity and luminance of an image, a color coordinate determination unit 224 that determines a color coordinate based on the measured chromaticity, and a luminance comparator that evaluates the difference between a predetermined target luminance and the measured luminance based on the measured luminance.

The main-gamma offset generating unit 230 generates a main-gamma offset value for the main gray-level data, corresponding to the result of the image analysis performed by the image analyzing unit 220.

More specifically, the main-gamma offset generating unit 230 may set a main luminance gamma offset value and a main color-coordinate gamma offset value. Here, the main luminance gamma offset value allows luminance to be adjusted corresponding to the difference between the measured luminance and the target luminance for the main gray level, obtained by the luminance comparator 226, and the main color-coordinate gamma offset value allows the chromaticity to be adjusted corresponding to the color coordinate for the main gray level, obtained by the color coordinate determination unit 224.

For example, the main-gamma offset generating unit 230 may set, as the main luminance gamma offset value, a gamma adjustment value capable of compensating for the difference between the target luminance and the measured luminance, and may set, as the main color-coordinate gamma offset value, a color-coordinate movement value capable of correcting the color coordinate distorted due to the luminance correction, variation in a manufacturing process, or the like.

For example, the gamma offset generating unit 230 may derive the gamma offset value corresponding to the luminance difference and/or the color coordinate from a predetermined formula, graph or the like. Accordingly, the gamma offset generating unit 230 generates main-gamma offset values respectively applied to red, green, and blue pixels for the main gray level.

The gamma voltage adjusting unit 240 may adjust a main-gamma voltage for the main gray level, corresponding to the main-gamma offset value set by the main-gamma offset generating unit 230, and supply the adjusted main-gamma voltage to the gamma voltage applying unit 210.

Particularly, the gamma voltage adjusting unit 240 can correct luminance by adjusting the main-gamma voltage corresponding to the main luminance gamma offset value. For example, the gamma voltage adjusting unit 240 can correct the luminance by adjusting the main-gamma voltage using the sum of the main-gamma voltage and the main luminance gamma offset value. In a case where the measured luminance is higher than the target luminance, the main luminance gamma offset value may be set as a negative (−) value. In a case where the measured luminance is lower than the target luminance, the main luminance gamma offset value may be set as a positive (+) value.

For example, the main-gamma voltage is an ideal gamma voltage value previously determined corresponding to the main gray level without considering a characteristic variation between the panels. The characteristic variation of each of the panels may be compensated by applying the main-gamma offset value to the main-gamma voltage as described above.

The gamma voltage adjusting unit 240 may correct chromaticity by adjusting the color coordinate using the main color-coordinate offset value.

The chromaticity correction may be simultaneously performed with the luminance correction, corresponding to the image analysis result. However, after the luminance correction is first performed, the chromaticity correction may be performed by analyzing an image corresponding to the result of the luminance correction and then adjusting the color coordinate. In this case, the color coordinate distorted due to the luminance correction can also be corrected, thereby effectively correcting the characteristic variation of each of the panels.

The gamma voltage applying unit 210 applies the gamma voltage corrected through the gamma voltage adjusting unit 240, i.e., the main-gamma voltage corrected according to the main gray level, to the data driver of each of the organic light emitting display devices. Accordingly, the corrected main-gamma voltage may be implemented using the sum of the main-gamma voltage and the main-gamma offset value.

In the case of the organic light emitting display device shown in FIG. 1, the power signal (e.g., the first power signal ELVDD and the second power signal ELVSS) configured to drive the pixel unit of each of the panels is output from a set provided at the exterior of the panel, and hence a variation between driving power signals applied to each of the panels may occur.

Therefore, in a case where the main-gamma offset value is applied, it is impossible to correct the driving power signals, particularly a luminance variation for each of the panels, generated according to the variation of the first power signal ELVDD.

Thus, according to some embodiments, the main-gamma offset value is set so as to sense the voltage of the first power signal ELVDD input from the exterior of each of the panels and perform gamma-voltage correction for the main gray-level data based on the sensed voltage. The sub-gamma offset generating unit 250 is further provided so as to correct the voltage variation between the first power signals ELVDD. Accordingly, a sub-gamma offset value is set and applied to the gamma-voltage correction corresponding to the gray levels, such that it is possible to prevent the color coordinate from being distorted in each gray level and luminance value. Further, it is possible to minimize the luminance variation for each of the panels.

More specifically, the driving voltage sensing unit 260 senses a driving power signal output from the DC-DC converter (not shown) mounted externally to the display panel. For example, the driving voltage sensing unit 260 senses a change in voltage of the first power signal ELVDD.

That is, whenever the first power signal ELVDD is varied, for example, by about 0.01V through the driving voltage sensing unit 260, the driving voltage sensing unit 260 senses and outputs the change in voltage.

The sub-gamma offset generating unit 250 functions to additionally generate a sub-gamma offset value so as to compensate for a change in luminance and color coordinate of the main gray level, caused by the change of the first power signal ELVDD sensed by the driving voltage sensing unit 260.

For example, the sub-gamma offset value may be set using a look-up table (LUT) stored in the sub-gamma offset generating unit 250.

The LUT is implemented by selecting a plurality of panels as models and experimentally estimating how far luminance and color coordinate deviate from target luminance and color coordinate depending on a change of the first power signal ELVDD with respect to main-gamma offset values respectively applied to red, green, and blue pixels.

If the sub-gamma offset value is set, the gamma voltage for the main gray level is corrected using the sum of the main-gamma offset value and the sub-gamma offset value, and the corrected gamma voltage is output to the data driver.

That is, the sub-gamma offset value for the main gray level, optimally set through the sub-gamma offset generating unit 250, is applied to the gamma voltage adjusting unit 250. Accordingly, the gamma voltage adjusting unit 240 sums up the main-gamma offset value and the sub-gamma offset value, and applies the sum of the main-gamma offset value and the sub-gamma offset value to a gamma voltage so as to adjust the gamma voltage. Then, the gamma voltage adjusting unit 240 supplies the adjusted main-gamma voltage to the gamma voltage applying unit 210.

Thus, the gamma voltage applying unit 210 applies the gamma voltage corrected through the gamma voltage adjusting unit 240, e.g., the main-gamma voltage corrected according to the main gray level, to the data driver of the organic light emitting display device. As a result, the corrected main-gamma voltage is implemented using the sum of the main-gamma voltage, the main-gamma offset value and the sub-gamma offset value.

The luminance and color coordinate correction performed by the luminance correction system according to some embodiments will be described with reference to the following data illustrated in FIGS. 3A and 3B.

FIGS. 3A and 3B are comparison experimental data showing luminance and color coordinate characteristics corrected by the luminance correction system as described and illustrated in FIG. 2.

FIG. 3A shows experimental data when the sub-gamma offset value is not applied. FIG. 3B shows experimental data when the sub-gamma offset value is applied.

That is, FIG. 3A shows experimental data when only the main-gamma offset value is applied to the corrected main-gamma voltage, e.g., when the maximum gray level (255 gray level) is set as a main gray level.

With reference to FIG. 3A, in a case where the first power signal ELVDD is applied as 4.649V, the luminance is 319.3 cd/m$^2$ and the color coordinate (x, y) of white is (0.2868, 0.3083). In a case where the first power signal ELVDD is varied and applied as 4.556V, the luminance is 266.0 cd/m$^2$ and the color coordinate (x, y) of white is (0.2820, 0.3017).

This means that the luminance and color coordinate for the same gray level has a considerable variation due to the variation of the first power signal ELVDD.

On the other hand, FIG. 3B shows experimental data when the sub-gamma offset value is set by applying the main-gamma offset value and the variation of the first power signal ELVDD to the corrected main-gamma voltage, and the maximum gray level (255 gray level) is set as a main gray level.

With reference to FIG. 3B, in a case where the first power signal ELVDD is applied as 4.649V, the luminance is 289.8 cd/m$^2$ and the color coordinate (x, y) of white is (0.2828, 0.3044). In a case where the first power signal ELVDD is changed and applied as 4.556V, the luminance is 390.1 cd/m$^2$ and the color coordinate (x, y) of white is (0.2844, 0.3041).

That is, according to the embodiment described and illustrated with reference to FIG. 2 above, the variation of luminance and color coordinate for the same gray level can be minimized regardless of the variation of the first power signal ELVDD.

In the embodiment of FIG. 2, when the change of the first power signal ELVDD is matched using a predetermined LUT stored in the sub-gamma offset generating unit 250, a value corresponding to the changed value is output as the sub-gamma offset value.

Here, the LUT is implemented by selecting a plurality of panels as models and then performing experimental estimation. However, in the LUT, the characteristic of each of the panels may not be substantially optimized.

Accordingly, in some embodiments, the sub-gamma offset generating unit applies the characteristic of each of the panels in real time rather than using the predetermined LUT, and generates and outputs a sub-gamma offset value corresponding to the characteristic of each of the panels. As a result, each of the panels may be calibrated in real time, thereby improving performance of the system.

Figure 4:
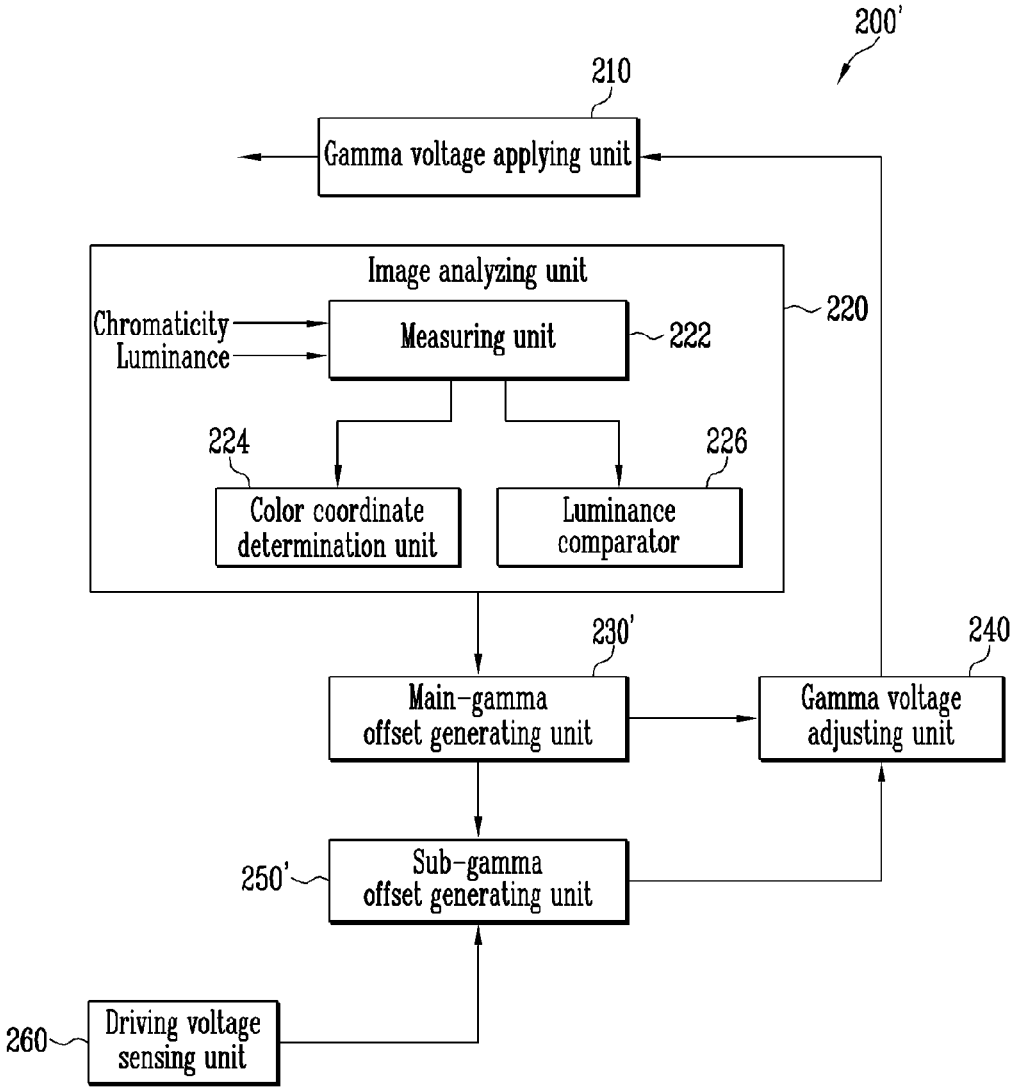
FIG. 4 is a block diagram of a luminance correction system according to some embodiments.

FIG. 4 is a block diagram of a luminance correction system according to some embodiments.

With reference to FIG. 4, similar to the embodiment of FIG. 2, the luminance correction system 200' according to the illustrated embodiment includes an image analyzing unit 220, a main-gamma offset generating unit 230', a gamma voltage adjusting unit 240, a gamma voltage applying unit 210, a sub-gamma offset generating unit 250', and a driving voltage sensing unit 260.

When comparing this embodiment with the embodiment of FIG. 2, the configurations and operations of the image analyzing unit 220, the gamma voltage adjusting unit 240, the gamma voltage applying unit 210 and the driving voltage sensing unit 260 are substantially similar to those in the embodiment of FIG. 2, and therefore, their descriptions will be omitted for convenience of illustration.

According to the embodiment of FIG. 4, the main-gamma offset generating unit 230' functions to generate a main-gamma offset value for the main gray-level data corresponding to the result of the image analysis performed by the image analyzing unit 220, similar to the embodiment of FIG. 2. In addition, the main-gamma offset generating unit 230' functions to perform step-up and/or step-down adjustment on the set main-gamma offset value for each of the red, green and blue data, to measure a luminance variation for the adjustment, and to output the luminance variation to the sub-gamma offset generating unit 250'.

The sub-gamma offset generating unit 250' functions to generate sub-gamma offset values for the respective red, green and blue data of the main gray level by combining information on the variation of the first power signal ELVDD provided from the driving voltage sensing unit 260 and information on the luminance variation for the adjustment of the main-gamma offset value provided from the main-gamma offset generating unit 230'.

For example, the sub-gamma offset value is used to compensate for a change in luminance and color coordinate of the main gray level, cause by the variation of the first power signal ELVDD. In the embodiment of FIG. 2, the sub-gamma offset value is selected from the predetermined values in the LUT. However, in the embodiment of FIG. 4, the sub-gamma offset value is set in real time by applying information on the luminance variation for the adjustment of the gamma offset value based on the characteristic of each of the panels.

Embodiments provide a luminance correction system for organic light emitting display devices, in which a main-gamma offset value is set by sensing the voltage of a first power signal ELVDD input from the exterior of each panel and performing gamma voltage correction for a main gray level based on the sensed voltage. A sub-gamma offset value is set to correct the variation in the voltage of the first power signal ELVDD, and is applied to the gamma voltage correction corresponding to the gray level, so that it is possible to prevent a color coordinate from being distorted in each gray level and luminance and to minimize the luminance variation of each of the organic light emitting display devices.

According to some embodiments, a luminance correction system for organic light emitting display devices is disclosed. The system includes an image analyzing unit that analyzes an image displayed in a pixel unit of each of the organic light emitting display devices and measures the luminance and color coordinate for main gray-level data, a main-gamma offset generating unit that generates a main-gamma offset value fore each color data in the main gray level, corresponding to the result of image analysis performed by the image analyzing unit, a driving voltage sensing unit that senses a change in voltage of a driving power signal input from an external source of each of the organic light emitting display devices, a sub-gamma offset generating unit that generates a sub-gamma offset value for each color data in the main gray level by applying the change in voltage of the sensed driving power signal, a gamma voltage adjusting unit that adjusts a main-gamma voltage for the main gray level corresponding to the set main-gamma offset value and the set sub-gamma offset value, and outputs the adjusted main-gamma voltage, and a gamma voltage applying unit that applies the main-gamma voltage adjusted by the gamma voltage adjusting unit to a data driver of each of the organic light emitting display devices.

The driving power signal input from the external source may be a high-level first power signal applied to the pixel unit. The main gray level may be set as the maximum gray level and/or intermediate gray level.

The image analyzing unit may include a measuring unit that measures the chromaticity and luminance of an image, a color coordinate determination unit that determines a color coordinate based on the measured chromaticity, and a luminance comparator that evaluates a difference between a predetermined target luminance and the measured luminance.

The main-gamma offset generating unit may set a main luminance gamma offset value for adjusting the luminance corresponding to the difference between the measured luminance and the target luminance for the main gray level, obtained by the luminance comparator, and a main color-coordinate gamma offset value for adjusting the chromaticity corresponding to the color coordinate for the main gray level, obtained by the color coordinate determination unit.

The sub-gamma offset value may be set using a look-up table (LUT) stored in the sub-gamma offset generating unit.

The main-gamma offset generating unit may perform step-up and/or step-down adjustment on the set main-gamma offset value for each color data in the main gray level so as to measure a luminance variation for the adjustment, and output the measured luminance variation to the sub-gamma offset generating unit.

The sub-gamma offset generating unit may generate a sub-gamma offset value for each color data in the main gray level by combining the sensed change in voltage of the driving power signal and the luminance variation for the adjustment of the main-gamma offset value provided from the main-gamma offset generating unit.

As described above, according to some embodiments, a variation in output voltage generated when a DC-DC converter is mounted in an external set is applied to gamma voltage correction of each organic light emitting display device, so that it is possible to prevent a color coordinate from being distorted in each gray level and luminance and to minimize the luminance variation of each of the organic light emitting display devices.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A luminance correction system for organic light emitting diode (OLED) displays, the system comprising:

an image analyzing unit configured to analyze an image displayed by a pixel unit of each of the OLED displays and measure the luminance and color coordinate for a main gray level, the image analyzing unit comprising:

a measuring unit configured to measure the chromaticity and luminance of an image;

a color coordinate determination unit that determines a color coordinate based on the measured chromaticity; and a luminance comparator configured to evaluate a difference between a predetermined target luminance and the measured luminance based on the measured luminance;

a main-gamma offset generating unit configured to:

generate a main-gamma offset value for each color data in the main gray level based on a result of image analysis performed by the image analyzing unit, generate a main luminance gamma offset value for adjusting the luminance corresponding to the difference between the measured luminance and the target luminance for the main gray level, obtained by the luminance comparator, and generate a main color-coordinate gamma offset value configured to adjust the chromaticity corresponding to the color coordinate for the main gray level, obtained by the color coordinate determination unit;

a driving voltage sensing unit configured to sense a change in voltage of a driving power signal input from an external source of each of the OLED displays;

a sub-gamma offset generating unit configured to receive the sensed change in voltage from the driving voltage sensing unit, and to generate a sub-gamma offset value for each color data in the main gray level based on the received sensed change in voltage of the sensed driving power signal;

a gamma voltage adjusting unit configured to adjust the main-gamma voltage for the main gray level corresponding to the set main-gamma offset value and the sub-gamma offset value, wherein the gamma voltage adjusting unit is further configured to output the adjusted main-gamma voltage; and a gamma voltage applying unit configured to apply the main-gamma voltage adjusted by the gamma voltage adjusting unit to a data driver of each of the OLED displays.

2. The system according to claim 1, wherein the driving power signal input from the external source corresponds to a high-level first power signal applied to the pixel unit.

3. The system according to claim 1, wherein the main gray level is set as the maximum gray level and/or an intermediate gray level.

4. The system according to claim 1, wherein the sub-gamma offset value is set based on a look-up table (LUT) stored in the sub-gamma offset generating unit.

5. The system according to claim 1, wherein the main-gamma offset generating unit is configured to perform step-up and/or step-down adjustment on the main-gamma offset value for each color data in the main gray level so as to measure a luminance variation for the adjustment, and wherein the main-gamma offset generating unit is further configured to output the measured luminance variation to the sub-gamma offset generating unit.

6. The system according to claim 5, wherein the sub-gamma offset generating unit generates a sub-gamma offset value for each color data in the main gray level by combining the sensed change in voltage of the driving power signal and the luminance variation for the adjustment of the main-gamma offset value provided from the main-gamma offset generating unit.

7. The system according to claim 1, wherein the external source includes a DC-DC converter configured to supply the power signal to the organic light emitting display device.

8. The system according to claim 1, wherein the sub-gamma offset value is set based on a real-time measurement of a characteristic of the organic light emitting display.

9. A method of correcting luminance in organic light emitting diode (OLED) displays, the method comprising:

analyzing an image displayed by a pixel unit of each of the OLED displays in an image analyzing unit;

measuring the luminance and color coordinate for a main gray level;

measuring the chromaticity and luminance of an image;

determining, in a color coordinate determination unit, a color coordinate based on the measured chromaticity; and evaluating, in a luminance comparator, a difference between a predetermined target luminance and the measured luminance of the image based on the measured luminance of the image;

setting a main-gamma offset value for each color data in the main gray level based on a result of image analysis performed by the image analyzing unit;

setting a main luminance gamma offset value for adjusting the luminance corresponding to the difference between the measured luminance and the target luminance for the main gray level, obtained by the luminance comparator; and adjusting the chromaticity corresponding to the color coordinate for the main gray level, obtained by the color coordinate determination unit sensing a change in voltage of a driving power signal input from an external source of each of the OLED displays;

setting a sub-gamma offset value for each color data in the main gray level based on the change in voltage of the sensed driving power signal;

adjusting a main-gamma voltage for the main gray level corresponding to the main-gamma offset value and the sub-gamma offset value;

outputting the adjusted main-gamma voltage; and applying the main-gamma voltage adjusted by the gamma voltage adjusting unit to a data driver of each of the OLED displays.

10. The method according to claim 9, wherein the driving power signal input from the external source corresponds to a high-level first power signal applied to the pixel unit.

11. The method according to claim 9, wherein the main gray level is set as the maximum gray level and/or an intermediate gray level.

12. The method according to claim 9, wherein the sub-gamma offset value is set based on a look-up table (LUT) stored in the sub-gamma offset generating unit.

13. The method according to claim 9, further comprising:

performing step-up and/or step-down adjustment on the main-gamma offset value for each color data in the main gray level so as to measure a luminance variation for the adjustment; and outputting the measured luminance variation to the sub-gamma offset generating unit.

14. The method according to claim 13, further comprising generating a sub-gamma offset value for each color data in the main gray level by combining the sensed change in voltage of the driving power signal and the luminance variation for the adjustment of the main-gamma offset value provided from the main-gamma offset generating unit.

15. The method according to claim 9, wherein the external source includes a DC-DC converter configured to supply the power signal to the organic light emitting display device.

16. The method according to claim 9, wherein the sub-gamma offset value is set based on a real-time measurement of a characteristic of the organic light emitting display.

* * * * *